United States Patent [19]

Bessouat et al.

[11] 4,156,403

[45] May 29, 1979

[54] STEAM SUPERHEATER-SEPARATOR WITH BLEEDING OF SATURATED DRY STEAM

[75] Inventors: Roger Bessouat; Jacques Marjollet, both of Paris, France

[73] Assignee: Stein Industrie, Velizy-Villacoublay, France

[21] Appl. No.: 857,261

[22] Filed: Dec. 1, 1977

[30] Foreign Application Priority Data

Dec. 8, 1976 [FR] France ..... 76 36970

[51] Int. Cl.[2] ..... F22G 1/00

[52] U.S. Cl. ..... 122/483; 122/34

[58] Field of Search ..... 122/32, 34, 483

[56] References Cited

U.S. PATENT DOCUMENTS 3,693,599 9/1972 Andreev et al. ..... 122/483

FOREIGN PATENT DOCUMENTS 2130244 12/1972 Fed. Rep. of Germany ..... 122/483

368448 4/1973 U.S.S.R. ..... 122/483

*Primary Examiner*—Kenneth W. Sprague

*Attorney, Agent, or Firm*—Haseltine, Lake & Waters

[57] ABSTRACT

A superheater-separator of steam coming from a high-pressure expansion turbine, before its admission into an expansion turbine at a lower pressure. The superheater-separator is divided into several vertical sectors comprising (from a central zone outwards) a zone for separating the water entrained by the steam and a superheating zone, at least one vertical section comprising only a zone for separating the water entrained by the steam for bleeding off a fraction of the dried steam before it is superheated.

4 Claims, 4 Drawing Figures

STEAM SUPERHEATER-SEPARATOR WITH BLEEDING OF SATURATED DRY STEAM

FIELD OF THE INVENTION

The present invention relates to a vertical superheater-separator for drying and superheating steam leaving a high-pressure expansion turbine before its admission to an expansion turbine at a lower pressure, by heat exchange with steam at a higher pressure, and with bleeding of a fraction of the dried steam before it is superheated. The superheater-separator is divided into a plurality of vertical sectors comprising, from a central zone outwards, a zone for separating the water entrained by the steam and a superheater zone.

PRIOR ART

Superheater-separators of this nature, divided into vertical separator and superheater sectors, but without bleeding of a fraction of the dried steam are disclosed in Swiss Pat. No. 494 920.

Such bleeding is necessary, in particular, in the heat exchanger circuits of light water nuclear power plants, where the water of the secondary circuit which is returned from the condenser to the heat exchanger with the steam coming from the reactor must be preheated by means of steam drained from the exhaust of the high-pressure expansion turbine. But the steam thus bled from the exhaust of the turbine contains a high proportion of water (about 11 to 13%), which gives rise to a great danger of erosion-corrosion in the pipes and equipment situated downstream from it bleeding point. If its is required to avoid the erosion-corrosion, these pipes and other equipment must be made of stainless steel, which makes their production much more expensive.

A possible solution would be to make the exhaust steam pass from the expansion turbine into a superheater-separator comprising a first zone provided with steam separators, surmounted by a second zone provided with steam superheater exchangers, with non-superheated dry steam being bled from between the first and the second zones. But due to the extra head loss in the nest of superheater tubes, the steam flow is not homogenous in the water separation zone, so that it is very difficult to obtain an even discharge of non-superheated steam and an even distribution of the steam to be superheated on the periphery of the superheater-separator, with minimal head loss. An irregular distribution of the steam to be superheated also causes local differences in temperature of the superheated steam, generating thermal stresses on the superheater-separator and on the superheated steam exhaust pipes.

SUMMARY OF THE INVENTION

The present invention seeks to remedy the above disadvantages and to provide a superheater-separator which ensures a uniform discharge of non-superheated steam and an even distribution of the steam to be superheated on the various superheater nests, with a temperature of its casing which is substantially uniform, preventing the occurence of thermal stresses, with minimal loss of head.

The present invention provides a vertical superheater-separator for drying and superheating the steam leaving a high-pressure expansion turbine before its admission to an expansion turbine at a lower pressure, the superheater-separator being divided into a plurality of vertical sectors comprising, from a central zone outwards, a zone for separating the water entrained by the steam and a superheater zone, wherein at least one vertical sector only comprises a zone for separating the water entrained by the steam for bleeding off a fraction of the dried steam before it is superheated.

The superheater-separator further preferably at least one of the following characteristics:

a peripheral zone occupied by the superheated steam;

the zone for the separation of the entrained water, which is not followed by a superheating zone, is separated by a double wall from the peripheral zone occupied by the superheated steam;

the wet steam is introduced in the lower part and the superheater-separator is provided with stacks of units for the separation of the entrained water and for superheating; the units for separating the entrained water are disposed progressively nearer to the axis of the central zone (going from the bottom to the top), so as to ensure a substantially constant discharge of wet steam from bottom to top; and the steam is superheated by nests of tubes provided on the superheated steam side with grids for the homogenisation of the steam discharge in the tubes.

BRIEF DESCRIPTION OF THE DRAWINGS

A steam superheater-separator with bleeding of dry saturated steam in accordance with the invention is described hereinbelow by way of example and with reference to the figures of the accompanying drawings in which.

DETAILED DESCRIPTION

Figure 1:
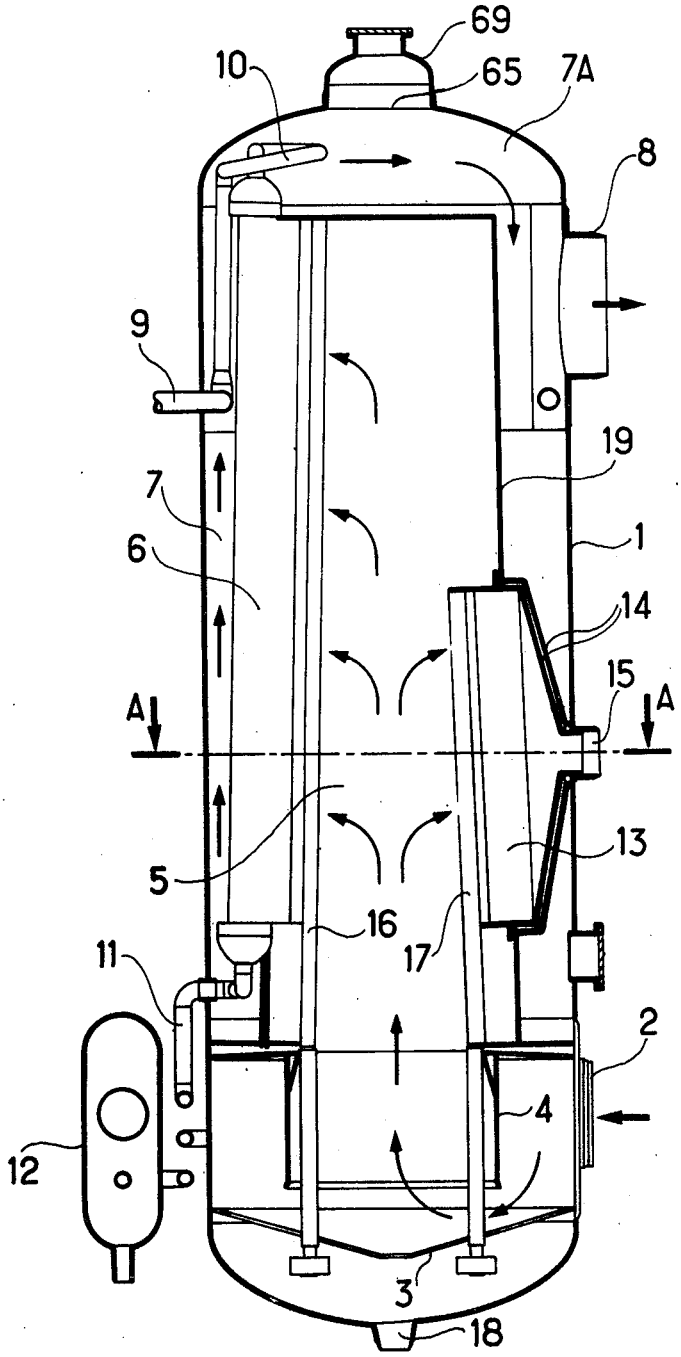
FIG. 1 is an axial cross-section of the superheater-separator.

The vertical superheater-separator shown in FIG. 1 comprises an external shell 1 provided at its lower end with an inlet nozzle 2 for wet steam coming from a high-pressure expansion turbine. The shell is provided with a conical internal bottom pan 3. A cylindrical case 4 whose lower edge is lower than the nozzle 2, forms a baffle with the conical pan and causes the web steam to change direction while the largest droplets of water contained in the steam are separated and gathered together on the pan. The empty central zone 5 of the superheater-separator is intended to allow the web steam to be distributed among the stacked superheating separation units shown generally at 6 and the non-superheating separation unit shown at 13. Between the various superheating separation units and the internal surface of the shell 1 there remains a space 7 which is occupied by the superheated steam, which ensures a uniformatly of the temperature of the shell and prevents the occurrence of thermal stresses both on the shell and on the connection pipes. This space is connected to an upper dome 7A of the superheater-separator and to a nozzle for removal of superheated steam towards a lower pressure expansion turbine.

The superheating separation units 6 are distributed in radial sectors. There are for example six superheating separation sectors 20, 21, 22, 23, 24, 25 and one non-superheating separation sector 26 (see FIG. 2).

These elements are not superposed vertically, but lean (going from bottom to top) towards the axis of the superheater-separator, so as to provide the wet steam with a passage having a substantially constant cross-section despite partial losses which flow into the successive stacks of superheater-separators. The central zone 5 thus has a substantially frustoconical shape. It is separated from the circulation zone of the superheated steam by a partition 19.

The superheater-separator comprises nests of tubes for circulating steam under a higher pressure, taken for example from the input of the high-pressure turbine. The steam inlet pipe leads to a torus, not shown, which feeds the various nests of superheating tubes, by means of expansion loops 10. At the output of the nest of tubes, which will be described in detail with reference to FIG. 3, the condensed steam is collected in a pipe 11 which conveys it to a receiving receptacle 12.

Figure 2:
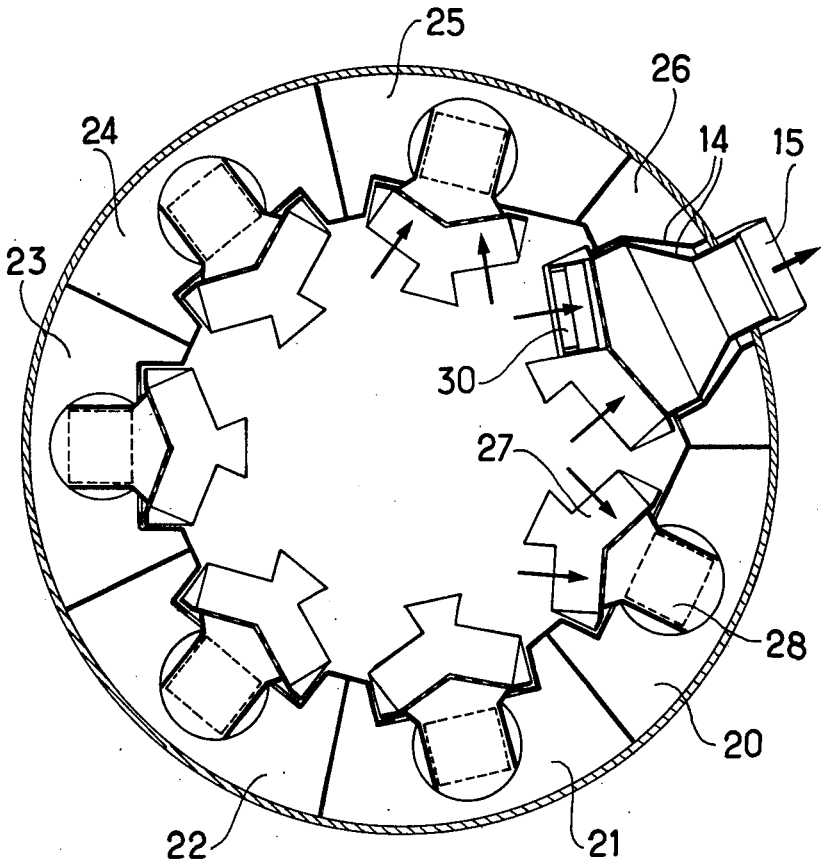
FIG. 2 is a horizontal cross-section taken along axis A—A of FIG. 1.

The separator 13 collects the steam which is to be collected dry without being superheated from a sector of the periphery (26, FIG. 2). To avoid producing temperature differences in the shell 1, the output of the separator 13 is provided with a double wall 14. The separator 13 leads to an outlet nozzle 15. It will be observed that by substituting the separator 13, detachably fixed in the wall 14, by a separator whose passage has a smaller or larger cross-section, the bleeding rate of dry non-superheated steam can be varied without modifying any other member of the exchanger.

The water separated in the separators preceding the superheaters is collected in pipes such as 16 and the water collected in the separator 13 is collected in a pipe 17. These pipes lead into the bottom of the superheater-separator, where a nozzle 18 allows removal of the collected water.

The horizontal cross-section in FIG. 2 along the axis A—A in FIG. 1, at the dried steam removal nozzle shows the various superheating-separation sectors such as 20, 21, etc., each sector such as 20 comprising a separator unit 27 and a superheating unit 28. In contrast, the sector for drawing off the steam which is to be dried without being superheated (and whose angular extent can be different from that of the other sectors as a function of the maximum dry steam output which is required) comprises ony one separator unit 30, followed by a pipe surrounded by the double wall 14 and leading into the outlet nozzle 15.

Figure 3:
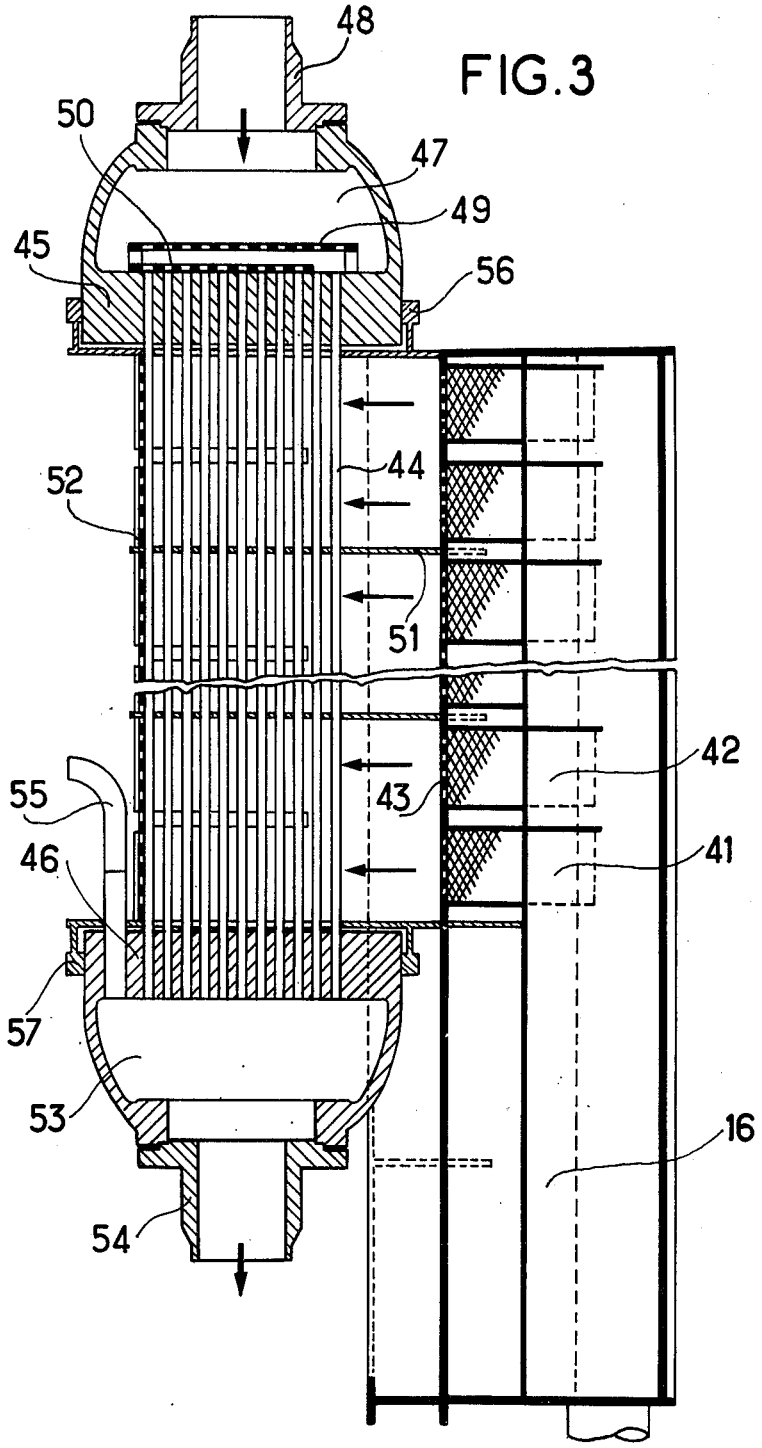
FIG. 3 is a cross-section on an enlarged scale of a stack of separators and the corresponding nest of superheating tubes.
Figure 4:
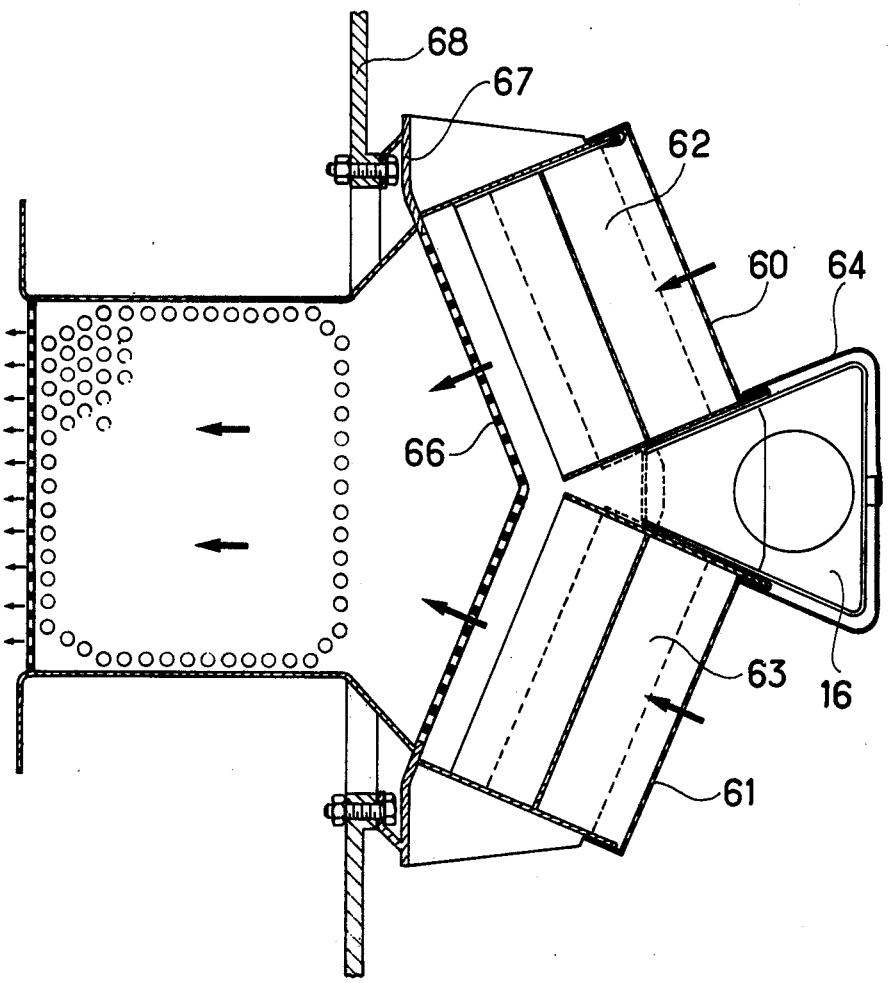
FIG. 4 is a horizontal cross-section on an even more enlarged scale of a separator and the corresponding nest of superheating tubes.

FIG. 3 is an axial cross-section on a larger scale of a vertical stack of separator units and the corresponding nest of superheating tubes, while FIG. 4 is a horizontal cross-section thereof. The separator units 41, 42, etc., shown schematically by cross-hatching, are of a known type, constituted, for example, by parallel corrugated sheets between which the wet steam flows. The sheets are distributed in two sets at an angle to each other and between which a supporting bracket 64 of generally triangular shape is disposed.

The separators rest against the partition 68 which delimits the wet steam chamber via sealing plates in the form of bent metal sheets 67 bolted at some points with a sufficient play to allow for differential expansion.

The water trapped by the separators 62, 63 runs downwards and is collected in pipes 16 extending to the bottom of the superheater-separator.

In the steam path, the separators are preceded by a grid 60 (or 61) and are followed by a grid 66 for homogenizing the discharge.

The nest of superheating tubes is composed of vertical tubes 44 connecting tubular plates 45 and 46. The upper tubular plate 45 is surmounted by a steam chamber 47 fed by a nozzle 48. Two distribution grids 49 and 50 provide a uniform discharge of the high-pressure steam through the tubes, despite the variable difference in temperature between the superheating steam at a uniform temperature and the dried steam to be superheated, whose temperature rises as it passes through the nest of tubes (from right to left in the figure). To do this, the diameters of the perforations of the grid 50 decrease (from right to left in the figure).

Horizontal partitions 51 separate the dried steam into partial flows each coming from a group of two superposed separators, so as to equalize the discharge of steam to be superheated passing through the nest of superheating tubes. On the opposite side of the nest of superheating tubes to the separators, a grid 52 equalizes the steam discharge.

The lower tubular plate 46 surmounts a chamber 53 for collecting condensed water, which is removed by a nozzle 54; the pipe 55 equalizes the pressure with the receiving receptacle 12 (FIG. 1).

The steam circuits are sealed with a packing box 56 which slides against the tubular plates and thus allows the expansion of the nest of tubes to be compensated.

Each set of separators and of a nest of superheating tubes can be dismantled independently from the others by bridging it into the free central zone and by extracting it through the orifice 65 situated in the upper end of the device after removing the bottom of the manhole 69 (see FIG. 1).

Although the superheater-separator which has just been described in detail with reference to the figures appears to be the preferred embodiment, it will be understood that various modifications can be made thereto without going beyond the scope of the invention, it being possible to replace some of its elements by others which would fulfill the same technical function. In particular, the separators can be of any other known type, such as baffle plates, metal gauzes and sealing means and the means for compensating expansions can be different.

What is claimed is:

1. A vertical superheater-separator for drying and superheating wet steam leaving a high-pressure expansion turbine before its admission to an expansion turbine at a lower pressure, the superheater-separator comprising a plurality of vertical sectors including, from a central inlet zone to a peripheral annular zone for collection of the superheated steam, means for separating water entrained by the steam and superheater means wherein at least one vertical sector only comprises the means for separating the water entrained by the steam and means for bleeding off a fraction of the dried steam before it is superheated.

2. A superheater-separator according to claim 1, wherein said means for separating the entrained water including a double wall separating the means for separating the entrained water from the peripheral zone occupied by the superheated steam.

3. A superheater-separator according to claim 1 including an inlet for the wet steam in a lower part, said separating means and superheater means collectively including stacks of units for separating the entrained water and for superheating the same, said means for separating the entrained water being disposed progressively nearer to the axis of the central zone (going from the bottom to the top), so as to ensure a substantially constant discharge of wet steam from bottom to top.

4. A superheater-separator according to claim 1, said superheater means including nests of tubes for superheating the dried steam, said tubes having superheated steam sides with grids for the homogenization of the steam discharge in the tubes.

* * * * *